United States Patent [19]

Bruner

[11] Patent Number: 4,911,280

[45] Date of Patent: Mar. 27, 1990

[54] METHOD AND APPARATUS FOR DEFLECTING COINS WHILE MAINTAINING AN ON-EDGE ORIENTATION

[76] Inventor: Philemon L. Bruner, 14119 Britoak La., Houston, Tex. 77079

[21] Appl. No.: 163,307

[22] Filed: Mar. 16, 1988

Related U.S. Application Data

[63] Continuation-in-part of Ser. No. 42,797, Apr. 27, 1987, abandoned.

[51] Int. Cl.[4] ..... G07D 5/02

[52] U.S. Cl. ..... 194/338; 194/344; 194/345; 453/9

[58] Field of Search ..... 194/334, 338, 344, 345, 194/347; 453/9, 14, 15

[56] References Cited

U.S. PATENT DOCUMENTS

| | | | |
|---|---|---|---|
| 1,087,307 | 2/1914 | Long | 194/338 X |
| 1,503,223 | 7/1924 | Bee . | |
| 1,907,064 | 5/1933 | Gottfried . | |
| 1,933,752 | 11/1933 | Parks et al. | 194/334 X |
| 2,049,170 | 7/1936 | Mills | 194/334 X |
| 2,113,797 | 4/1938 | Miller | 453/9 |
| 2,442,890 | 6/1948 | Gabrielsen et al. . | |
| 2,453,437 | 11/1948 | Hokanson . | |

FOREIGN PATENT DOCUMENTS

| | | |
|---|---|---|
| 3007484 | 9/1981 | Fed. Rep. of Germany . |
| 469837 | 8/1914 | France . |
| 464439 | 4/1937 | United Kingdom . |

*Primary Examiner*—Joseph J. Rolla
*Assistant Examiner*—Edward S. Ammeen
*Attorney, Agent, or Firm*—Arnold, White & Durkee

[57] ABSTRACT

A coin separator/rejector system includes a plurality of coin races which are disposed in a compact coin receiver body. The races have at least one protrusion along their length so as to deflect downwardly traveling coins and force these coins to alter both their attitude and direction of travel to encounter apertures formed in the receiver body between successive coin races. Coins of a selected diameter travel downwardly along any given coin race for ultimate deposit or credit. Coins of less than the selected diameter are directed into an alternate direction and path of travel along an alternate or secondary race where they are either credited or rejected.

30 Claims, 6 Drawing Sheets

Fig.3A
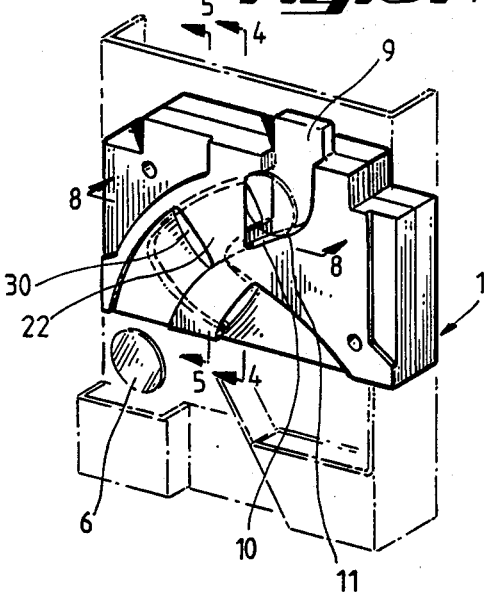
Fig.8
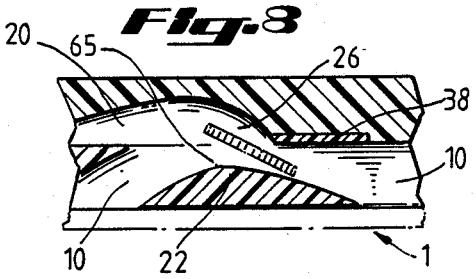
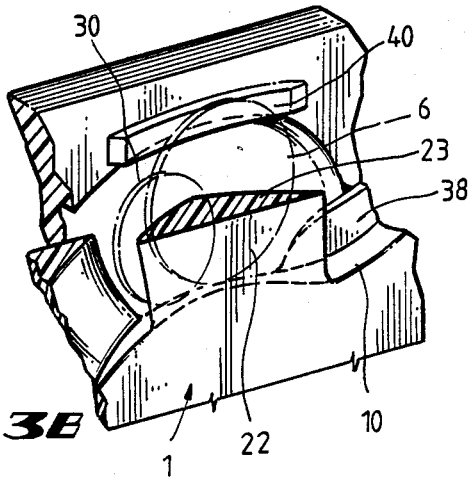
Fig.3B
Fig.4
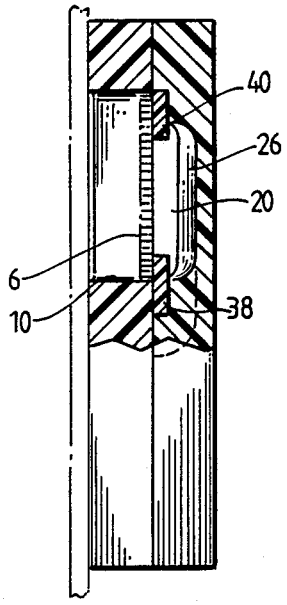
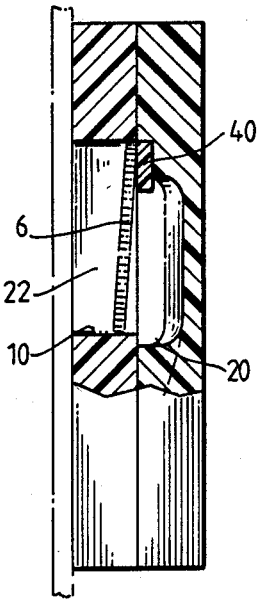
Fig.5
Fig.6
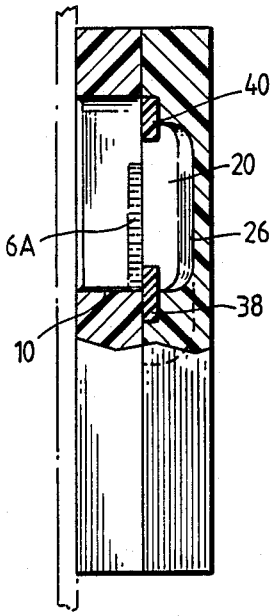
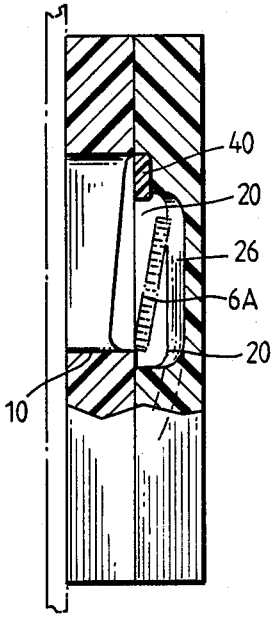
Fig.7

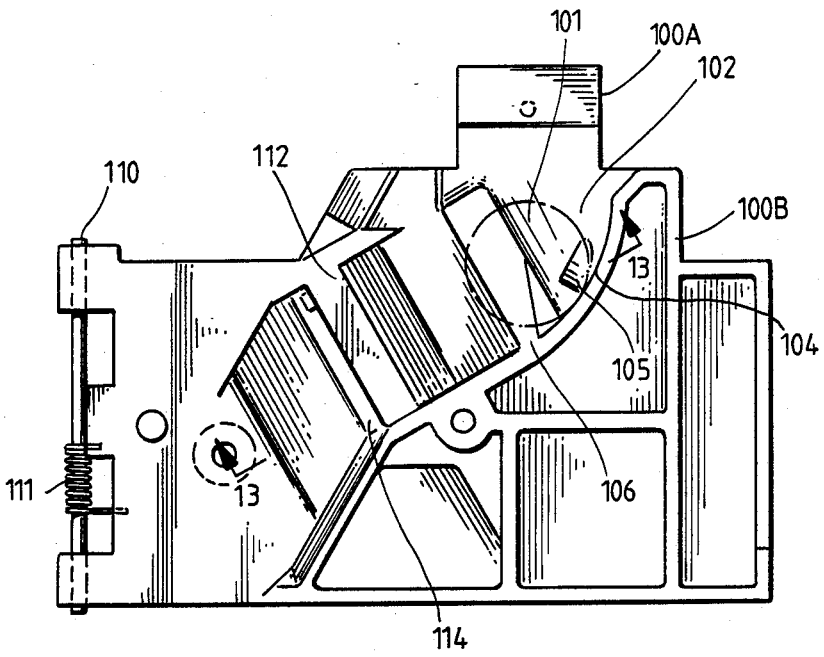
Fig.9
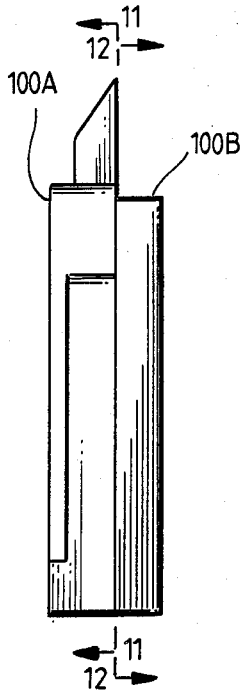
Fig.10
Fig.11
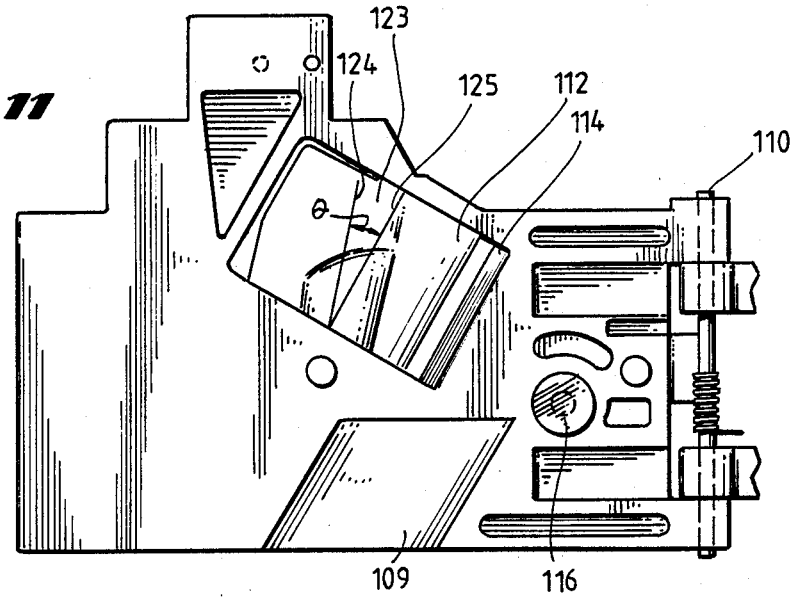

METHOD AND APPARATUS FOR DEFLECTING COINS WHILE MAINTAINING AN ON-EDGE ORIENTATION

CROSS REFERENCE TO RELATED APPLICATIONS

This application is a continuation-in-part of applicant's copending application Ser. No. 042,797, entitled "Apparatus and Method for Rejecting Coins," now abandoned.

BACKGROUND OF THE INVENTION

1. Field of the Invention

The present invention relates generally to a coin separator and rejector for use in vending machines, coin operated telephones, video game machines or other applications where mechanical sorting, selection and rejection of coins is required. More particularly, this invention relates to a coin separator and rejector system which utilizes principles of inertia and controlled deflection to selectively discriminate and collect coins deposited in a coin operated machine or appliance. The present invention also relates to a method of separating and rejecting coins employing the principles of the aforementioned apparatus.

2. Description of the Prior Art

The simplest type of coin-operated machine is one which requires a single coin of a single denomination for operation. In this instance, the basic consideration or problem involving a separator/rejector is to accept the single coin and to reject all others. The problem is solved in one aspect by designing the coin inlet to accept coins no larger in diameter than the desired coin. In a second aspect, the coins which pass through the inlet enter a separator/rejector which accepts the desired coins —i.e., the largest coins - and rejects all smaller coins.

More complex coin operated machines are designed to perform a variety of functions such as accepting more than one coin denomination, accepting combinations of coin denominations, returning change, and returning undesirable coins, tokens, and counterfeit coins. The more complex machines therefore require more complex separator/rejectors. Some of these separator/rejectors, for example, sort the coins and direct coins of different desired denominations into separate chutes or cash boxes, or into escrow devices in advance of the cash boxes.

In general, coin-operated machines must be rugged as well as reliable. Numerous attempts have been made toward the design of an effective, yet trouble-free, coin separator/rejector to be used in coin operated machines and the like, so that coins which are inserted in the machines may be readily organized and separated. The desirable coins are deposited for credit, and the undesirable coins are rejected and/or ultimately returned to the user.

Many times, the principal design feature of a rejector is to limit the operation of a machine to a particular denomination of coin, as dictated by the price of the merchandise, service, or entertainment available through the machine. Other times, a principal desire is to limit the size of the machine as dictated by space concerns. There is generally very limited space in most machines for a coin rejector; and this is especially the case when the rejector must be capable of accepting a variety of coin denominations. In almost all instances, it is desirable to reject pennies and foreign coins.

A variety of rejectors has evolved to address the need to discriminate among various coin denominations. Early coin rejectors used a combination of coin diameter and gravity to reject all coins but those of a preselected denomination. One example of such a rejector is seen in U. S. Pat. No. 917,629. This patent describes a coin rejector with a spiral coin race containing an aperture through a portion of its length. As a coin descends in this device, it is pulled toward the outer diametrical extent of the coin race. If the coin is too small (and thus not of a desired denomination) to be supported at its top and bottom as it passes over the aperture, it is simply hurled out of the coin race. Disadvantages associated with the apparatus of the device described in this patent include its cumbersome configuration. The spiral shape of the device requires that it be at least as wide as the diameter of the desired coin. Additionally, the use of a spiral configuration involves an overall vertical length which would be prohibitive in many contemporary applications.

Another design using gravity as a means for rejecting inappropriately sized coins is seen in U.S. Pat. No. 2,014,506. This device employs an inclined coin race which is fitted with an aperture along a portion of its length. The coin race itself is fitted with an inclined bottom track and a low tolerance upper guide. In this device, coins of less than a minimum diameter travel along the coin race and "tumble" out of the device upon encountering the aperture, since they are no longer supported at both their top and bottom. Although this type of device appears sound in principal, it is cumbersome in size, and it has a propensity to fail or "jam", especially when bent or oversized coins are introduced into the coin chute. This device also fails to maintain coins in a preferred on-edge orientation at all times.

To address the need to process multiple denomination coins, a number of coin rejectors have been suggested which use a plurality of coin inlet slots disposed along the face of the machine, each slot being connected to a different coin race. Such a device is seen in U.S. Pat. No. 3,768,618. In this device, a number of coin chutes are connected to a corresponding number of coin inlet portals disposed along the machine body. Each coin chute is formed in an angled, downwardly inclined fashion with an aperture or "window" formed along part of its length. When coins of less than a minimum diameter move down these coin chutes, they "topple" through the windows, thereby resulting in rejection.

A multiple race setup such as that disclosed in U.S. Pat. No. 3,768,618 also has many of the same drawbacks described above. It is inherently bulky because of the number of coin chutes it needs to process multiple coin denominations. Thus, the proper sorting and collection of three different denominations of coins would require at least three separate coin slots, each with its own coin rejector.

Due to a general trend toward miniaturization, as well as the need in the industry to separate multiple denomination coins, more compact coin devices have been designed that employ a plurality of moving parts in order to establish a correct coin credit system with coins introduceable from a solitary coin inlet. Such a coin rejector is seen in U.S. Pat. No. 2,292,628. In this and similar designs, a coin inserted in a solitary coin slot on the face of the machine travels downward until it engages a series of coin cradles or "flippers" disposed within the apparatus itself. Depending on the width and diameter of the coin, the coin moves downward and across the face of the rejector via a plurality of coin handling cradles until it reaches a particular coin outlet slot. In this fashion, multiple denominations of coins may be used in the machine, with undersized domestic coins (usually pennies) or foreign coins being rejected and returned to the user. Many of the drawbacks associated with this design revolve around the overall complexity of the device itself. In this and similar coin separating devices, up to 80 separate or moving parts may be used, each part subject to varying degrees of wear and contamination from dirt or other corrosives, soon reducing the overall reliability and efficiency of the device and resulting in undesirable incidences of "jamming." Such a multi-component device is also highly sensitive to moisture, and often requires periodic balancing. High incidences of "jamming" resultant from inoperability of the device significantly decrease the profitability of any given vending operation. Servicing "jams" is expensive and often results in user frustration and ultimately nonuse of the machine or appliance itself.

SUMMARY OF THE INVENTION

The present invention addresses problems associated with prior art devices by providing a compact coin system which is capable of receiving and separating multiple diameter coins inserted through a solitary coin inlet.

In a broad aspect, the present invention comprises a system in which a coin is introduced at the upper end of a downwardly extending coin race. The coin travels downwardly in the race and in a vertical disposition, i.e., on-edge. The race has vertically disposed walls on each side of the coin which help to guide the coin on its way. The walls are preferably spaced laterally a sufficient distance to tolerate coins which are bent but still capable of passing through the entrance to the race. Most importantly, the race is configured so as to enhance the natural passage of the coin through the system, thereby minimizing undesired deflection while maintaining control over the coin.

As the coin travels down the race, a positive, laterally disposed force is applied to the coin which causes the coin to be deflected to a course which is angled laterally relative to its original course. Concomitantly or sequentially, a second positive, laterally disposed force may be applied to the coin which causes the coin to tilt along with the change in direction. Thus, the coin preferably changes direction and also tilts toward the new direction, while remaining in a generally vertical or "on-edge" disposition.

As the downward-traveling coin is directed from one wall of the race to the opposite wall, an aperture is positioned in the opposite wall for the purpose of receiving any coin smaller in diameter than a desired coin. Along the top of the aperture is a downward extending flange or section of wall which depends sufficiently to engage the upper edge of the desired coin but not any smaller coin. Preferably also, a similar flange or section of wall projects upwardly along the lower boundary of the aperture sufficiently to engage the lower edge of the desired coin. Preferably, the bottom flange does not extend along the entire length of the aperture.

As each coin is thrust and inclined toward the aperture, each desired coin finds itself spanning the aperture and continuing along the coin race past the aperture. Each smaller coin, however, travels into the aperture for further disposition. Each desired coin and each smaller coin preferably remain in a generally vertical disposition. Gravity acts on both types of coins, during their separation, but it is the lateral force or forces which primarily effect the separation. These lateral forces are created by the overall design of the coin race.

Depending on the nature of the machine or device with which the coin rejector of the invention is employed, the coins passing through the aperture described above may be processed in several ways. Thus, if the machine is designed to accept and operate on coins of a single denomination, all smaller coins are simply routed to a second or return race or chute which returns them to the user. On the other hand, if the machine is designed to accept more than one denomination, each coin passing through the aperture is engaged by a second, downward race which then routes them past a second aperture. In the second race, a lateral force or combination of forces again thrusts each coin toward the second aperture where any coin smaller than a second desired size is passed through the second aperture for further disposition. Meanwhile, each coin desired at this second stage continues its travel along the second race past the second aperture. In alternate embodiments of the invention, the primary coin race, protrusion and associated aperture setup may be designed to accept only smaller coins, diverting instead larger coins to a second aperture for further disposition.

The above system is applicable to coins of several desired denominations, simply by the addition of a sufficient number of apertures and races. In all such applications, it is important that the overall sequence of races and apertures be configured to keep the several coins in a vertical disposition and in substantially continuous motion. While each subsequent race may extend downward in the same general direction as the first race, it is a preferred feature of the invention to have each subsequent race travel in a downward direction generally opposite to its preceding course. This design results in a very compact arrangement in which coins of several denominations cascade downwardly and back and forth, with coins of progressively smaller diameter (or larger diameter depending on the desired application) separated at successive levels in the cascade.

In a preferred form, the lateral forces delivered to coins opposite each aperture are obtained by configuring or designing the wall opposite the wall containing the aperture to provide the forces. Thus, a protrusion or shoulder may be designed in the wall which will both deflect and tilt each coin as it passes by. This protrusion is preferably tapered along its upstream face to provide a gradual change in direction and/or tilt as desired.

The overall shape of the coin separator/rejectors of the invention may vary as desired. It is specifically contemplated that a block-like structure be used to replace the box-like collectors that are used in many present-day vending machines, coin-operated soft-drink laundry machines, and the like. It is further contemplated that at least one embodiment of the present invention be used to replace specific parts of existing rejectors, thereby incorporating the preexisting framework of the rejectors while substantially eliminating all moving parts. Replacement of rejector components which employ coin cradles or flippers is of particular interest. It is specifically contemplated that the rejectors of the invention be molded or otherwise fabricated from synthetic resins in preference to metals.

In a preferred embodiment of the present invention, a series of coin races is formed together in a rejector body, the uppermost coin race being connectedly disposed below a solitary coin inlet. The coin races themselves are closely situated in side-by-side planes in a substantially coplanar fashion with each other, and are connected by a series of apertures formed in the receiver body. One or more protrusions are situated along the side walls of the coin races opposite these apertures, the number of protrusions and apertures being commensurate with the application for which the rejector is used. Disposed at the bottom and top of each aperture is a pair of retaining flanges which are configured to retain the upper and lower diametrical extents of the largest coin as it approaches the aperture from a laterally opposite protrusion. Beyond the aperture from the protrusion is the next coin race which is designed to receive coins deflected through the aperture, and guide the coins downwardly in the receiver body for further processing and collection. In this fashion, multiple denominations of coins may be accurately processed in a very compact volume.

As noted, the present apparatus is characterized by a plurality of coin races situated in approximate coplanar fashion to each other, these races being collectively disposed in a rejector body. As a coin is inserted in the coin inlet, it travels downward along the uppermost or primary coin race until it engages a protrusion which preferably forces the coin to alter both its direction and attitude of travel. In traversing the protrusion, the coin is forced to describe a generally arcuate path leading around the protrusion while inclined on its vertical axis in the direction of the aperture.

If the coin is greater than a selected diameter, the coin is physically held in the primary coin race by the cumulative effect of the retaining flanges, and is then carried downward in the primary coin race for ultimate collection or credit. If the coin or token is less than the selected diameter, the coin is not held in the primary coin race but is instead deflected through the aperture formed between the primary and secondary (or alternate) races where it preferably engages a deflecting shoulder. This deflecting shoulder is formed in the upper extent of the secondary coin race and serves to realign the coin for proper travel down the secondary race. Utilizing a series of races and protrusions in this fashion, coins may be selectively routed through a coin race network for ultimate recovery and/or credit at the bottom of the rejector body.

In another embodiment of the present device, one or more magnets may be situated in the rejector body such that ferrous coins or tokens passing through the rejector body may be held or deflected into a return coin race. Preferably, these magnets are situated well down the primary coin race so as to avoid a backlog of coins behind the magnet that might otherwise disable the rejector. In this fashion, some precaution may be taken to prevent the insertion of invalid coinage for ultimate collection and credit.

Although the system of the invention operates remarkably free from jamming by bent coins and the like, specific means may be provided to dislodge mangled coins or other items which may find their way into the device from time to time. Dislodging levers and similar devices already in use may be adapted for this purpose. It is a common practice in the case of rejectors employing coin cradles to build a rejector in segments which are hinged together with a coin path housed between two segments. By depressing a suitable lever, the hinged segments are forced apart, and a trapped coin simply drops out. As suggested above, in a preferred embodiment of the device, the rejector body of the invention may be formed in multiple distinct sections so as to be directly adaptable to a conventional coin freeing mechanism. Using this setup, activation of the freeing mechanism would cause the distinct sections or plates of the receiver body to move apart about a hinged area t one edge of the receiver body, such that any coins trapped or lodged within the receiver body may free fall for ultimate recovery by the user.

It is also envisioned in yet another embodiment of the present invention, that the primary coin race may be directed downwardly through the receiver body in a substantially linear fashion. Disposed along the primary race may be a series of protrusions and apertures adapted to receive and process a variety of coins in a manner similar to that described earlier. A series of secondary coin races may be arranged in a substantially planar fashion alongside the primary race in a fashion to receive coins rejected from the primary race. A device structured in this fashion may be useful in applications where there is a need for a coin receiver having a small width along its face. In yet another preferred embodiment of the present invention, an alternate or secondary coin race may be positioned upstream of the protrusion such as to be accessible by coins having a certain minimum diameter. In such a fashion, coins of less than a selected diameter would drop into this alternate coin race immediately after entering the rejector body.

The present invention provides many advantages over the prior art. First, the overall simplicity of the present device markedly reduces problems associated with mechanical failure due to wear, corrosion, and dirt buildup caused by environmental exposure as well as constant use. In most embodiments, the present system has no moving parts and is therefore substantially unaffected by moisture or other corrosive agents that may be present in the area where the device is used. Additionally, the present system has no electrical components which might be particularly affected by such corrosive agents. This is felt to be very important if a rejector is to be used in such applications as car washes, laundromats, or other areas where steam or moisture are present.

Second, the design of the present invention allows for continuous uninterrupted operation, greatly reducing the need for periodic maintenance or delicate balancing of the machine in which it is used. This is important since vending machines, video game machines and the like are often exposed to bumping or jostling during operation. It has been found that such movements can soon render conventional rejector setups at least partially inoperable.

Third, the present invention allows for effective handling of coins which are bent or damaged. This function is accomplished by the internal coin race configuration which encourages coins to undergo a sliding motion as they move through the system even if they are unable to roll about an axis. This function is also accomplished by the tolerances of the coin races themselves, which in most embodiments do not unduly discriminate as to the width of the coin. Thus, bent coins may be accepted and readily processed.

Additional advantages associated with the present invention include its ability to maintain control over the coin during all aspects of its travel through the system, thus eliminating random deflections such as may be caused by free fall of coins. This is felt important since controlled coin handling allows the present system to accurately process a plurality of different diameter coins, organizing each for credit, and returning any nondesired coins or tokens to the user. This feature also substantially reduces the noise commonly associated with coin rejectors. Most importantly, this feature substantially contributes to the overall efficiency of the system itself by providing for a constant, regulated flow of coins.

As earlier described, the coins processed by coin-operated machines are generally passed through coin chutes to deposit boxes, or to accumulators or escrow devices and thence to deposit boxes. The system of the present invention facilitates the delivery of coins to the coin chutes in a vertical disposition. Movement of the coins is thereby under substantially continuous control; tumbling and erratic movements of the coins are greatly reduced.

Some conventional rejectors use coin races which are vertically disposed but tilted from the vertical such that coins traveling along the races may fall by gravity through apertures arranged along the races toward which the coins are inclined. It is contemplated that races of this nature may be used with the present invention, but their use is not preferred since travel of a coin while leaning against a wall may tend to slow down the coin. Moreover, a positive lateral force on a coin acting to tilt the coin is preferred to relying on gravity alone to pull the coin from a coin race.

The present system offers a further advantage over the prior art by providing a low cost compact coin separator/rejector which is able to efficiently process a variety of different diameter coins.

BRIEF DESCRIPTION OF THE DRAWINGS

The invention may be better understood by reference to the drawings listed below.

FIG. 3A is a perspective, partially phantom view of the embodiment of FIG. 2, showing the interrelation of the primary and secondary races;

FIG. 3B is a cutaway perspective view of one embodiment of FIG. 3A, and illustrates the general shape and positioning of a deflecting protrusion in relation to an aperture;

FIG. 4 is a cross-sectional illustration taken along the plane 4—4 in FIG. 3A, and illustrates the attitude of a coin of a preferred diameter as it travels downward along the coin race;

FIG. 5 is a cross-sectional illustration taken along the plane 5—5 in FIG. 3A, and illustrates the attitude of a coin of a preferred diameter as it encounters the protrusion;

FIG. 6 is the same view as FIG. 4, and illustrates the attitude of a coin less than a preferred diameter as it travels downward along the coin race prior to encountering a protrusion;

FIG. 7 is same cross-sectional view as in FIG. 3A, and illustrates the attitude of a coin less than a preferred diameter as it encounters the protrusion and is deflected into a secondary coin race; and FIG. 8 is a cross-sectional view taken along the section lines 8—8 in FIG. 3A.

FIG. 9 is a side view of one preferred embodiment of the invention.

FIG. 10 is an end view of the preferred embodiment illustrated in FIG. 9.

FIG. 11 is a side view of the preferred embodiment as illustrated in FIG. 9 taken along section lines 3—3 in FIG. 10.

DETAILED DESCRIPTION OF THE PREFERRED EMBODIMENT

Figure 1:
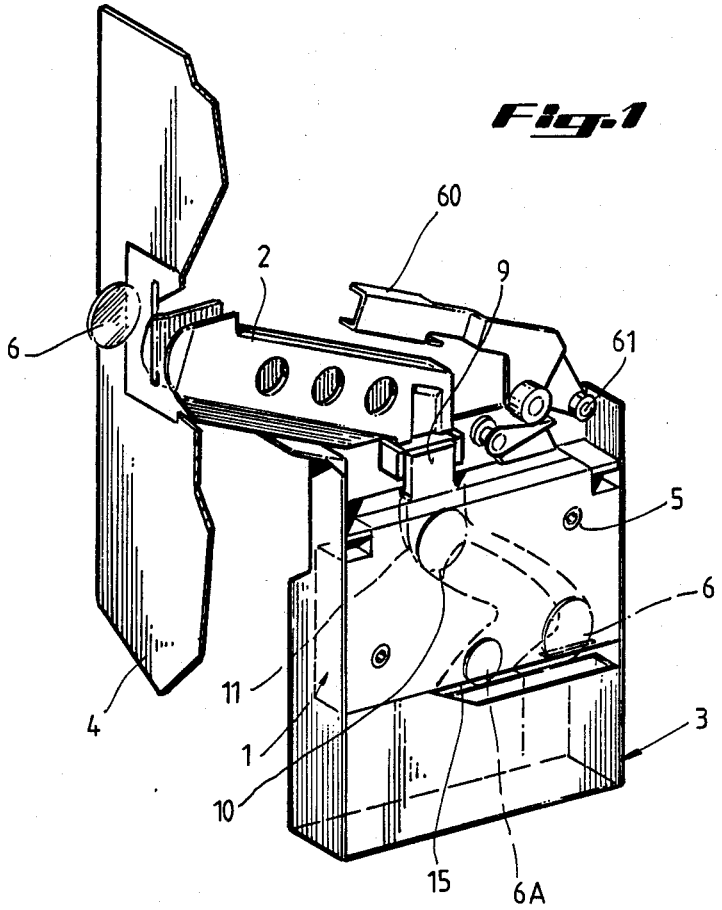
FIG. 1 is a perspective view of one embodiment of the device of the invention as it may be fitted in an existing common type of coin rejection unit.

FIG. 1 illustrates a general embodiment of the invention as it would be mounted in a conventional coin-operated machine such as a cigarette machine. A typical cigarette machine operates solely on quarters and rejects all other coins such as dimes, nickels and pennies. A well known rejector used in such machines is manufactured by National Rejectors, Inc. A form of that particular rejector employs coin cradles to accept quarters; other coins are rejected.

The apparatus shown in FIG. 1 includes a cutaway panel 4 of a vending machine, a coin neck slot 2, and a coin inlet 9 at the lower end of the slot 2. The coin rejector housing 3 is located behind the panel 4 and is adapted to receive the rejector 1 such that the coin inlet 9 is directly above the upper end of the coin race 10 in the rejector.

Figure 2:
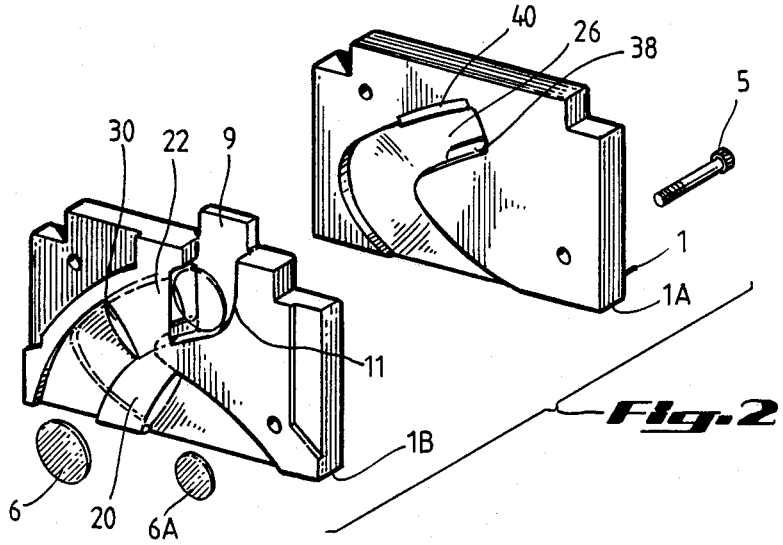
FIG. 2 is an exploded perspective view of the embodiment of FIG. 1 taken from the back side of FIG. 1.

As shown in FIG. 2, the rejector 1 may be an assembly of two sections or slabs 1A and 1B held together by several screws or bolts 5. Alternatively, these sections may be held together via a hinge and spring set up (not shown).

Referring back to FIG. 1, the apparatus shown there typically includes a lever 60 pivotally mounted on the housing 3 by a pivot 61. A roller 62 mounted on the lever 60 is positioned to contact and depress the wedge 63 which is also pivotally mounted on the housing 3. Depression of the lever 60 causes the wedge 63 to force its way between the sections or slabs 1A and 1B and to separate them sufficiently to enable coins stuck in the race to drop out of the rejector. As in conventional rejectors, sections 1A and 1B may be resiliently held or hinged together rather than rigidly bolted together.

As seen in both FIG. 1 and FIG. 2, when the sections 1A and 1B are joined or held together, they define a first or primary coin race 10 which is inclined downward from the coin inlet 9 to a coin exit portal 15. A coin receiving shoulder 11 preferably forms the uppermost portion of the race 10, and is curved to impart a smooth continuous transition for a coin entering the race 10 from the inlet 9.

A protuberance or protrusion 22 is spaced down the race 10 from the inlet 9. This protrusion serves to deflect a coin traveling in the race 10 toward an aperture 30. Aperture 30 runs along the primary race 10 and communicates between the race 10 and a second or secondary coin race 20. As perhaps best shown in FIGS. 2 and 4–8, this secondary race 20 runs parallel to the primary race 10 for a short distance and then curves and runs substantially counter in its lower portion to race 10 to its separate coin exit 15. Coins successfully traversing the protrusion and aperture setup are directed to the portal 64.

Aperture 30 is formed between races 10 and 20 and is bounded above and below by lower and upper flanges or ledges 38 and 40, respectively. These flanges extend laterally into the aperture 30 distances sufficient to engage the upper and lower edges of a selected coin 6, i.e. a quarter, but insufficient to engage the similar edges of other smaller coins, i.e., nickels, dimes and pennies.

As illustrated in FIG. 3B, the upper flange 40 is preferably arcuate in shape. This arcuate shape is desired since flange 40, in cooperation with the protrusion 22, defines the configuration of the coin race 10 in which the selected coin 6 travels as it is laterally displaced by the protrusion 22. As thus designed, the combination of these two elements, 22 and 40, provide a smooth transition for the coin 6 descending through the rejector 1. In such a fashion, complete control is exerted over the coin at all times during the selection and rejection process.

The protrusion itself 22 tapers as it extends down the race 10, until it reaches the apex or contact edge 65. This apex or contact edge 65 is substantially opposite the aperture 30. In preferred embodiments, this contact edge 65 is inclined upstream as will be further described herein.

In operation, coins inserted in the opening to the neck 2 travel down the neck, where they enter the rejector body via the coin inlet 9. As they drop through the inlet 9, they strike the shoulder 11 which guides them down the primary coin race 10. As they travel along the race 10, the coins are vertically disposed and tend to roll or slide along the race. As the coins encounter the protrusion 22, they are pushed or deflected by the protrusion 22 toward the aperture 30. The protrusion causes each coin to experience a lateral change of direction in the general direction of the aperture 30. Preferably, the protrusion 22 also causes each coin to lean or incline toward the aperture.

Depending on the size of each coin, the coin will experience one of two events as it approaches the aperture 30. If the coin is of a desired size, i.e. a quarter, the upper and lower edges of this coin 6 will encounter the upper and lower flanges, 38 and 40 respectively, be turned on its vertical axis, and then continue down the coin race 10 in a vertical disposition until it exits through the coin portal 15. In effect, the coin 6 remains in the coin race 10 by traversing or working its way around the protrusion 22.

If a coin smaller than a specified size, such as coin 6A, is traveling down the race 10, the bottom edge of this coin will initially engage the lower flange 38 but not the upper flange 40. Then, as the coin 6A continues along the race 10, the lateral thrust imparted by the protrusion 22 causes the upper edge of the coin to pass under the upper flange 40 add through the aperture 30 into the secondary coin race 20. At the same time, the lower edge of the coin 6A preferably runs beyond the end of the lower shoulder or flange 38 and through the aperture 30 into the secondary race 20.

The lower flange 38 is preferably drawn only partially across the aperture 30 in order to properly align the smaller coin 6A in a plane substantially parallel to the secondary coin race 20. In such a fashion, the coin 6A maintains an on-edge orientation as it negotiates the transition from the primary coin race 10 to the secondary coin race 20. Maintenance of such an on-edge orientation greatly reduces the width necessary in the rejector body 1 while greatly enhancing overall operational efficiency.

As the coin 6A travels into the race 20, it encounters the deflecting shoulder 26. As explained earlier, this shoulder is designed to impart a smooth change of direction in the coin 6A and to assure its vertical disposition as it now travels down the secondary race 20. This deflecting shoulder 26 preferably is tapered in a fashion substantially parallel to the upstream face of the protrusion 22. As shown in FIG. 2, the coin 6A ultimately exits the rejector body 1 through the exit portal 64.

A preferred embodiment of the present invention is seen by reference to FIGS. 9–13. As noted in the discussion of the general embodiment, the rejector body 100 is generally characterized by a two-piece assembly, 100A–100B, which is joined about a pivot or hinge 110. To maintain a close contacting relationship between the two pieces, a spring or similar tension means 111 may be utilized. In such a fashion, the two pieces may be mechanically separated to enable coins stuck in the rejector body to drop out of the rejector.

In this embodiment, a primary coin race 106 is disposed in the body 100, said race defining a coin deflecting shoulder 104 at its upper extent terminating in a coin outlet 109. Along the coin race is positioned a protrusion 112 situated approximately opposite, but slightly offset of an aperture 114. Referring to FIGS. 9 and 11, the protrusion 112 defines a deflecting surface 123 at its upstream face, said surface contacting the descending coins 101 about a line or edge of contact 124. As may be seen by reference to FIG. 11, this contact edge or launching surface 124 is angularly oriented with respect to a line 125 drawn normal to the primary coin race 106. More specifically, the bottom of this line of contact 124 is displaced downstream such that the launching surface 124 as a whole is inclined upstream at an angle $\theta$. It has been found that the angle $\theta$ between the line measured to the primary race 125 and the line of contact 124 should be such as to establish the line of contact 124 approximately normal to the support surface on which the vending machine is situated in order to consistently and controllably channel various diameter coins 101 through the aperture 114. Orientation of the protrusion 112 in this manner prevents coins 101 entering coin race 106 from experiencing premature deflection upon engagement with the surfaces within the race 106, thus resulting in undesired wear within the rejector 100 and enhancing the risk of jamming. Further, the described orientation of the protrusion 112 also aids in the processing of bent of damages coins which would ordinarily cause a failure or jam.

Figure 12:
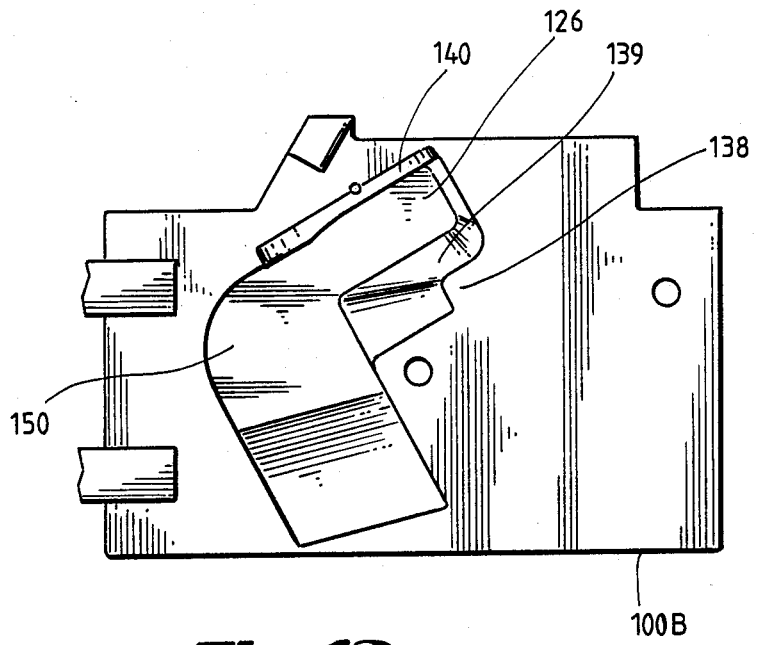
FIG. 12 is a side view of the preferred embodiment illustrated in FIG. 9 taken along section lines 4—4 in FIG. 10.
Figure 13:
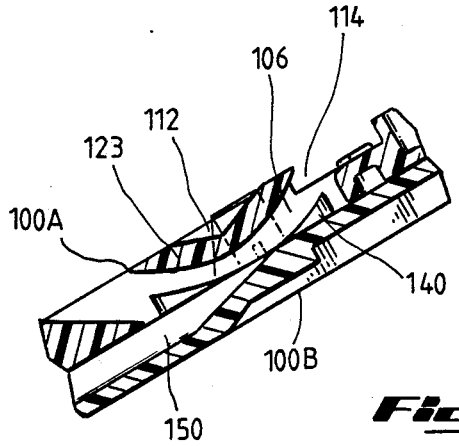
FIG. 13 is a cross section top view of the preferred embodiment shown in FIG. 9.

Referring to FIGS. 11–13, coins 101 encountering the contact edge 124 of the deflecting surface 123 are deflected against lower and upper retaining flanges 138 and 140, respectively. As described in association with the general embodiment (FIGS. 1–9), the upper retaining flange 140 is arcuate in shape so as to define a curved primary coin race 106 for the coin 101 as it navigates the protrusion 112. This may be best seen in the cutaway top view of FIG. 13. In this fashion, greater control may be maintained on the coins 101 in all attitudes of their travel along the primary race 106. Further, such a configuration significantly reduces the amount of unnecessary and nondesired deflection by reducing the "tolerance" available to a coin as it is forced to pivot on its axis, hence allowing more consistent selection and rejection processing.

In this preferred embodiment, the lower retaining flange 138 extends part way across the aperture 114 culminating in a beveled surface 139. This surface 139 preferably forms both the top and sides of the lower flange 138 and provides a smooth transition between the primary race 106 and the deflecting shoulder 126 formed at the upper end of the secondary coin race 150. Utilization of such a beveled surface 139 results in a controlled, upright movement of coins rejected through the aperture 114.

Referring again to FIG. 9, a secondary protrusion 105 may be formed at the base of the deflecting shoulder 104 upstream from the primary protrusion 112. Preferably, this protrusion 105 extends part way along the base of the primary race 106. In operation, the protrusion 105 causes the bottommost portions of coins 101 to be laterally displaced, and thus more preferably oriented, upon encountering the combination protrusion 112 and aperture 114.

As described earlier, it is a particular feature of the invention that it is directly applicable to many conventional coin operated machines. This is especially true of vending machines and other machines which employ coin cradles. In these machines, the rejector of the present invention can be simply substituted for the conventional cradle type rejector. Such substitution has been observed to reduce markedly the operating problems associated with the conventional rejector.

In this regard, it has been found generally more economical to accept an occasional slug than to risk jamming the rejector by trying to reject the slug. Further, the cost of a single service call far outweighs the cost of absorbing the loss caused by a slug. Should slugs become a problem, however, the rejector of the invention may be readily modified using conventional magnets and the like for dealing with the problem. An example of such an adaptation is seen in FIGS. 11 and 13 where a small magnet 116 is situated adjacent the primary coin race 106. In preferred embodiments, this magnet 116 may assume an "on" or "off" position, depending on whether the magnet is depressed into the body piece 100A or situated so as to be in contacting relation with coins as they pass through the aperture 114.

An alternate embodiment of the present device is seen in FIGS. 14–18. These figures illustrate a multiple coin rejector adapted to process four different coin types, e.g., a quarter 302, dime 301, nickel 303 and penny 304, for ultimate collection or rejection. Similar to the rejector previously described, this embodiment utilizes principles of controlled deflection and collection to process even bent or mangled coins.

Figure 14:
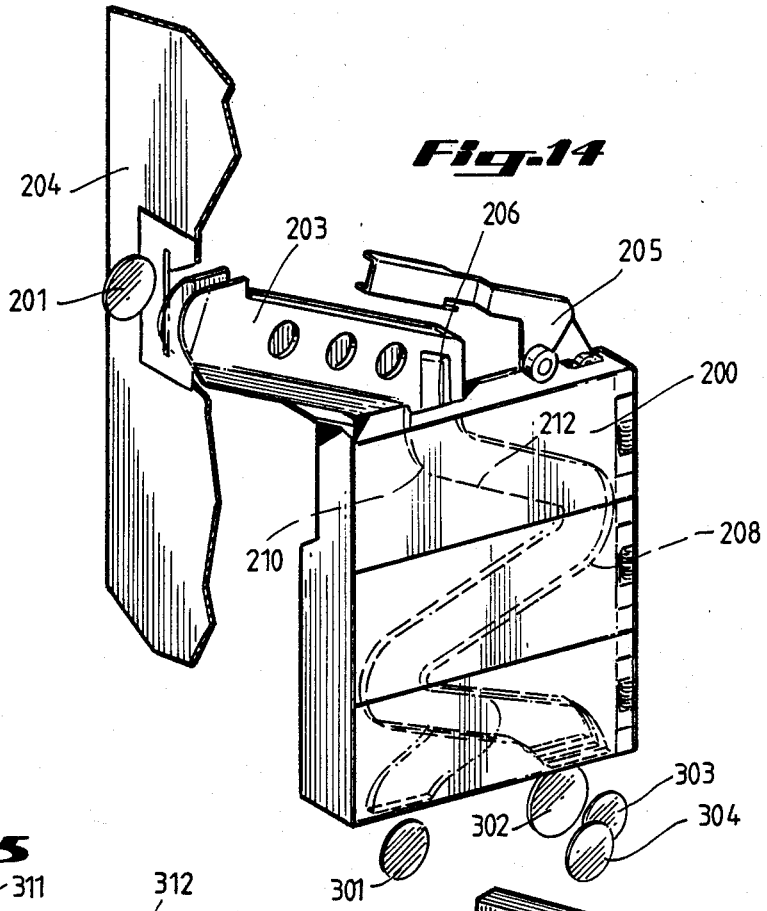
FIG. 14 is a perspective view of a second preferred embodiment of the invention having multiple coin capability.
Figure 15:
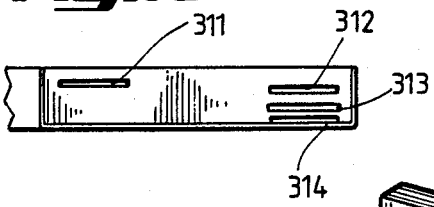
FIG. 15 is a bottom view of the embodiment illustrated in FIG. 14.

As seen in FIG. 14, this embodiment is also adapted to replace existing coin rejectors presently utilized in existing vending machines. The apparatus illustrated in FIG. 14 includes a cutaway view of a vending machine panel 204, a coin slot neck 203, and a coin inlet 206 situated at the lower end of the neck 203. This coin inlet 206 is formed in the upper portion of the rejector body 200.

Figure 16:
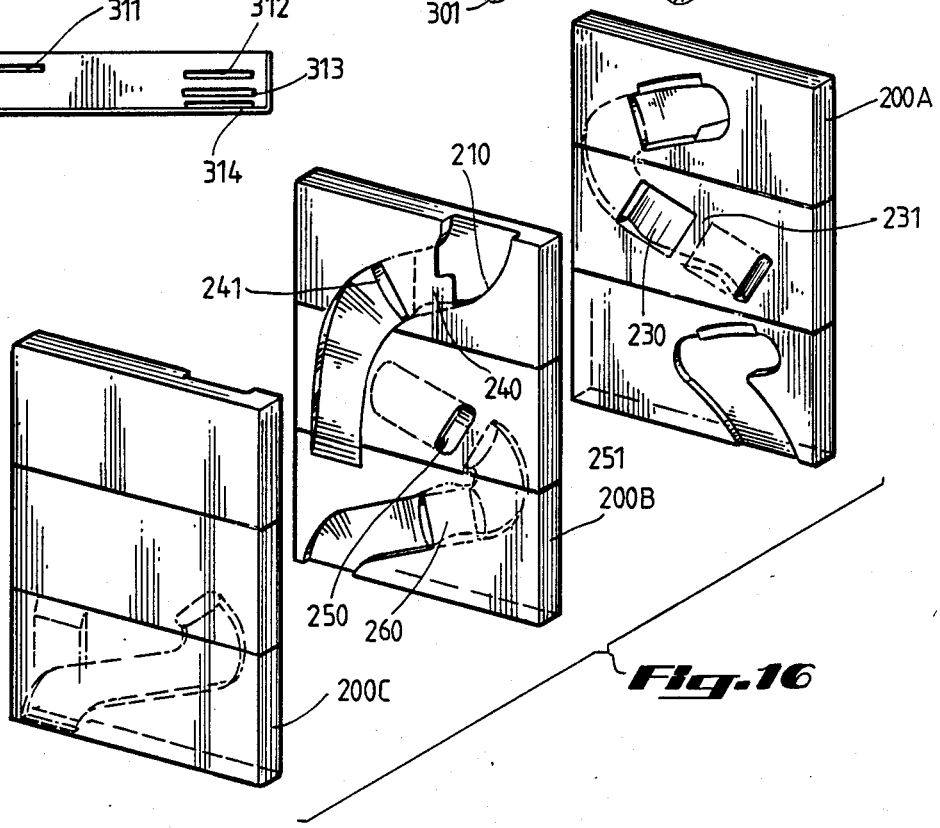
FIG. 16 is an exploded view of the preferred embodiment illustrated in FIG. 14.
Figure 17C:
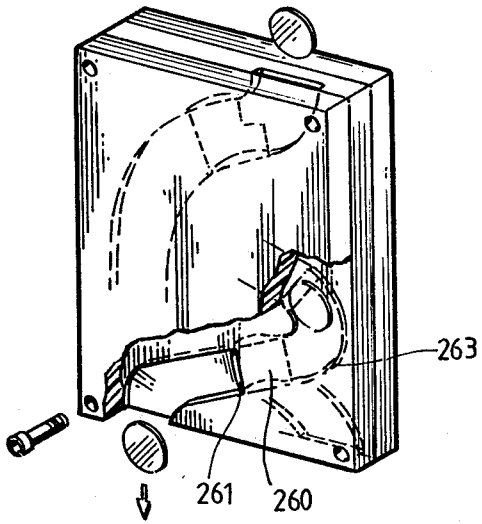
FIGS. 17 A-D are cutaway, perspective views of the embodiment shown in FIG. 14, illustrating the routing of various diameter coins as they pass through the rejector body.
Figure 17B:
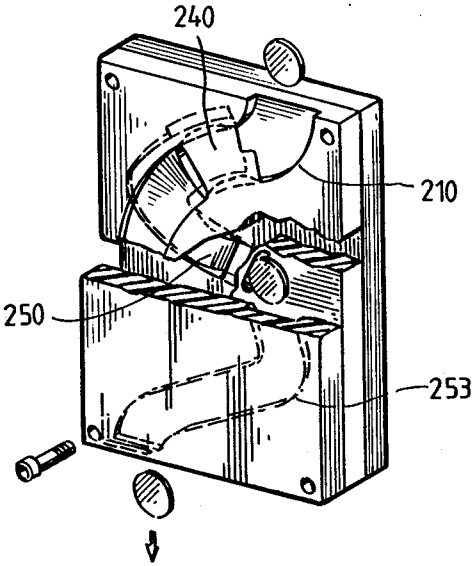
Figure 17D:
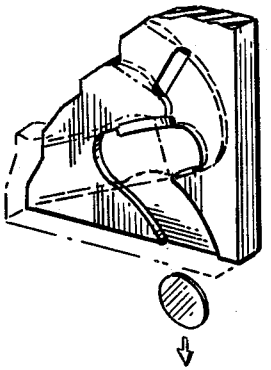
Figure 17A:
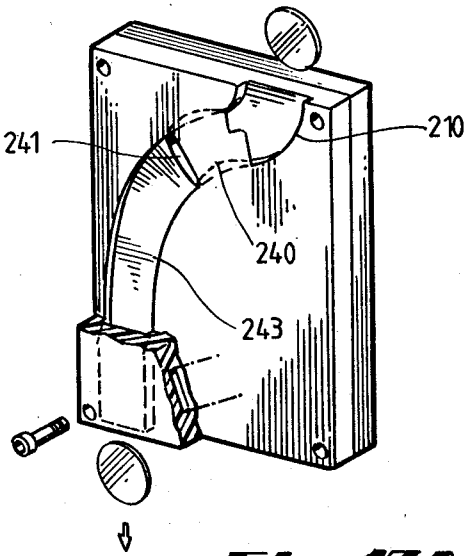

Referring to FIG. 16, the rejector body 200 itself is preferably formed of three separate plate assemblies, 200A–C, which are pivotably connected about one edge by a hinge (not shown), similar to that described in association with the embodiment illustrated in FIGS. 9–13. These plates may be held in close engagement by a suitable resilient means such as a hinge or the like (not shown). In such a fashion, the plates may be mechanically separated via lever 205 as previously described.

Similar to the embodiments previously described, this multiple coin embodiment is provided with a primary coin race 212, said coin race 212 defining a deflecting shoulder 210 at its upper extent and a plurality of outlets 311–314 at its lower extent. See FIG. 15. Preferably, this primary coin race 212 descends through the body in a cascade-like manner in order to organize the coins in their descent as they are processed by interaction with a number of protrusions and corresponding apertures.

Referring to FIGS. 16–17, this multiple coin embodiment is preferably adapted to differentiate and collect coins of four different denominations. Hence, a threefold separation system is utilized, including the use of a primary protrusion 240 and associated aperture 241, a secondary protrusion 250 and aperture 251, and a tertiary protrusion 260 and aperture 261. These protrusions are situated in the primary 212, secondary 253, and tertiary 263 races, respectively, and operate in a manner previously described in association with the general embodiment.

For example, the protrusions situated along the individual races preferably define an upstream face having a line of contact (not shown) angularly oriented with respect to a line drawn normal to the primary race 212. This angulation is similar to the previously described in association with FIGS. 9–13. In this embodiment also, apertures 241, 251 and 261 are preferably framed by upper and lower retaining flanges, where the upper flange is arcuate in shape. Other features of the preferred embodiment previously described may also be incorporated.

What is claimed is:

1. A coin separator and rejector comprising:

a rejector body having an inlet coin portal in an upper portion thereof;

a downwardly inclined primary coin race positioned in the body in a generally vertical disposition below the inlet portal and adapted to receive coins from the portal;

a secondary coin race formed in the rejector body, said secondary race being connected to the primary coin race by an aperture formed in the rejector body between the two races, said aperture generally having a top and a bottom;

a coin deflecting protrusion situated along the primary coin race and positioned downstream from the inlet portal and proximate the aperture, said protrusion adapted to deflect coins traveling down the primary coin race toward and through the aperture while in a vertically disposed, on edge orientation; said protrusion defining a launching surface having a linear contact edge at a leading upstream face, the bottom of which edge is displaced downstream, such that the upper portion of said edge is inclined upstream;

a first retaining flange formed between the primary and secondary coin races and along a bottommost portion of the primary coin race, said flange in combination with the primary race defining a lip partially drawn across the aperture; and a second retaining flange formed between the primary and secondary coin races along an uppermost portion of the primary coin race, said second retaining flange defining an arcuate contact surface, said flange defining a lip drawn across the aperture so as to retain coins of a selected minimum diameter from passing through the aperture.

2. The coin separator and rejector of claim 1 where the first retaining flange is formed along the bottom portion of the aperture.

3. The coin separator and rejector of claim 1 where the primary coin race at its upper extent defines a coin receiving shoulder configured to guide a coin down the race from the inlet portal.

4. The coin separator and rejector of claim 3 where the coin receiving shoulder is arcuate in shape.

5. The coin separator and rejector of claim 1 where the inlet portal is adapted to receive coins in a plane substantially parallel to a first plane described by the primary coin race.

6. The coin separator and rejector of claim 5 where the coin inlet portal is adapted to receive coins of various diameters and widths.

7. The coin separator and rejector of claim 1 where the primary coin race is of sufficient dimension to allow the unobstructed passage of coins of varying diameters, including coins which are bent or damaged.

8. The coin separator and rejector of claim 1 where the primary coin race directs coins of a selected diameter along a substantially parabolic path, such that the coin inlet portal is in a substantially vertical alignment with a collecting outlet of the rejector.

9. The coin separator and rejector of claim 1 where the secondary coin race is adapted to receive coins deflected through the aperture and direct said coins downward to an outlet return portal.

10. The coin separator and rejector of claim 1 where the secondary coin race is situated substantially coplanar to the primary coin race.

11. The coin separator and rejector of claim 1 further comprising:

a downwardly inclined tertiary coin race formed in the rejector body, said tertiary coin race being connected to the secondary coin race by an aperture formed in the rejector body between the two races.

12. The coin separator and rejector of claim 11 where a deflecting protrusion is situated along the secondary coin race substantially opposite the aperture formed between the secondary and tertiary coin races.

13. The coin separator and rejector of claim 12 where a retaining flange is formed along the secondary coin race opposite the deflecting protrusion.

14. A coin receiver for a coin-operated device which comprises:

a body member having a coin slot opening in an upper portion sized to receive coins of more than one diameter, said body member having a substantially vertical axis;

a first coin race extending downward into the body from the slot opening and configured to transmit a coin in a vertically disposed orientation, said race including a pair of walls laterally spaced sufficiently to enable a bent said coin to be so transmitted;

a first wall being inclined relative to the vertical axis so as to deflect a coin transmitted down the race against a second wall, said second wall defining a contact surface at an upstream edge, the bottom of which surface is displaced downstream such that an upper portion of the contact surface is inclined upstream;

the first wall defining a first aperture bounded by upper and lower boundaries vertically spaced to engage and guide the largest diameter coin capable of entering the slot opening down the first coin race past said aperture and to engage only the lower portion of coins of smaller diameter than the largest diameter coin so as to pass such coins of smaller diameter through said aperture in a vertically disposed, on edge orientation; and a second coin race spaced beyond said first aperture to receive each said smaller coin passing through the first aperture, said second coin race being downwardly inclined and including a second pair of walls laterally spaced to transmit said smaller diameter coins in a vertically disposed orientation.

15. The coin receiver of claim 14 wherein the upper boundary of said first aperture forms an arcuate contact surface.

16. A coin separator and rejector comprising:

a rejector body;

a downwardly extending primary coin race disposed in said body, said race having a coin inlet portal at its upper extent and having walls depending downstream from said coin inlet portal and arranged substantially in a plane parallel with a plane defined by said coin inlet portal, the combination adapted to transmit coins received from the inlet portal in a vertically disposed orientation;

a coin deflecting protrusion formed in the primary race and adapted to cause coins to alter their path of travel in at least one plane as they move downward in the receiver body, said protrusion defining a linear launching surface, the bottom of said surface being displaced downstream from the top such that the entire surface is inclined from a line normal to the primary race; and a downwardly inclined secondary coin race in said body defining at its upper end an aperture communicating with the primary race and of a size so as to selectively receive coins smaller than a selected diameter traveling along the altered path, said aperture including means for passing coins into said second coin race in a vertically disposed, on edge orientation.

17. The coin separator and rejector of claim 16 further comprising a retaining flange formed along a top of the aperture formed between the primary and secondary coin races, said retaining flange having an arcuate contact surface.

18. A method for separating and rejecting coins, comprising:

passing a coin along a downwardly inclined, primary coin race in a generally vertical attitude;

mechanically subjecting the coin within the race to an uneven lateral force such that the coin is deflected in both its direction and attitude of travel, said lateral force carrying the coin to contact an upper and lower gauge, said upper gauge defining an arcuate contact surface;

physically gauging the diameter of the deflected coin;

moving each deflected coin of a minimum diameter down the primary race; and moving each deflected coin of less than the minimum diameter down a secondary coin race while maintaining each coin in an on edge orientation.

19. A coin rejector comprising:

a rejector body having a coin inlet portal in an upper portion thereof capable of receiving coins of a first selected diameter and smaller diameters;

a first downwardly extending primary coin race adapted at its upper end to receive said coins from said inlet portal, said primary race being of sufficiently narrow width to transmit said coins downward in a first vertically disposed attitude;

a first coin deflecting surface formed along a first side of the first race and configured to mechanically deflect coins traveling along the first race toward the opposite side of the first race in a vertically disposed attitude, said coin deflecting surface culminating in a launch surface defining a contact edge at an upstream face, the bottom of said contact edge displaced from its top such that the edge is inclined upstream from a line drawn normal to the primary race;

a first aperture in the opposite side of the first race along the path of the deflected coins, said first aperture being vertically and laterally dimensioned to selectively pass some of the deflected coins through the first aperture, said first aperture having at its upper extent an arcuate contact surface; and a downwardly extending second coin race beyond said aperture from said first coin race; said second coin race arranged to receive coins passing through the first aperture and to transmit the coins down the second race in a vertically disposed attitude.

20. The coin rejector of claim 19 in which the first coin deflecting surface is inclined to such an extent as to mechanically incline coins traveling along the first race toward the opposite side of the first race in a vertically disposed attitude.

21. The coin rejector of claim 20 in which the first and second coin races extend downwardly in the same general direction.

22. The coin rejector of claim 19 in which the first and second coin races extend downwardly in generally diverging directions.

23. The coin rejector of claim 19 further comprising:

a second coin deflecting surface formed along a first side of the second race, said second coin deflecting surface inclined with respect to the primary race so as to deflect coins traveling along the second race toward the opposite side of the second race in a vertically disposed attitude;

a second aperture in the opposite side of the second race along the path of the coins traveling in the second race, said second aperture being vertically and laterally dimensioned to selectively pass coins in the second race through the second aperture which have diameters smaller than a second selected diameter; and said opposite side of the second race deflecting all of the coins in said second race which are smaller than the second selected diameter.

24. A coin separator and rejector comprising:

a rejector body having an inlet coin portal in an upper portion thereof;

a downwardly inclined primary coin race positioned in the body in a generally vertical disposition below the inlet portal and adapted to receive coins in a generally on-edge orientation from the portal;

a secondary coin race formed in the rejector body, said secondary race being connected to the primary coin race by an aperture formed in the rejector body between the two races;

a coin deflecting protrusion situated along the primary coin race and positioned downstream from the inlet portal and proximate the aperture, said protrusion having a contact edge laterally protruding toward said aperture so as to deflect coins traveling down the primary coin race toward the aperture;

means to maintain the coins passing through the aperture in a generally vertically disposed, on-edge orientation; and a first retaining flange formed between the primary and secondary coin races and along the topmost portion of the primary coin race, said flange in combination with the primary race forming a lip sufficient to retain coins of a selected minimum diameter from passing through the aperture.

25. The coin separator and rejector of claim 24 where the protrusion defines a launching surface having a linear contact edge, the bottom of which edge is displaced downstream, such that the top of the contact edge is inclined upstream.

26. The coin separator and rejector of claim 24 further including a second retaining flange formed between the primary and secondary coin races along a bottommost portion of the primary coin race, said first retaining flange defining an arcuate contact surface.

27. The coin separator and rejector of claim 24 where the first retaining flange is formed along the top of the aperture.

28. A coin receiver for a coin-operated device which comprises:

a body member having a coin slot opening in an upper portion sized to receive coins of more than one diameter;

a first coin race extending downward into the body from the slot opening and configured to transmit a coin in a vertically disposed orientation, said race including a pair of walls laterally spaced sufficiently to enable a bent said coin to be so transmitted;

one said wall being provided with a coin deflecting surface formed along one wall so as to deflect a coin transmitted down the race against the other said wall;

the opposite said wall defining a first aperture bounded by upper and lower boundaries vertically spaced to engage and guide the largest diameter coin capable of entering the slot opening down the first coin race past said aperture and to engage only the lower portion of coins of smaller diameter than the largest diameter coin so as to pass said coins of smaller diameter through said aperture, said aperture including means for maintaining said coins in an on-edge orientation as they pass through said aperture;

a second coin race spaced beyond said first aperture to receive each said smaller coins passing through the first aperture, said second coin race being downwardly inclined and including a second pair of walls laterally spaced; and means to transmit said smaller diameter coins in a vertically disposed, on-edge orientation.

29. A coin separator and rejector comprising:

a rejector body;

a downwardly extending primary coin race disposed in said body, said race having a coin inlet portal at its upper extent and having walls inclined to transmit coins received from the inlet portal in a vertically disposed orientation;

a coin deflecting protrusion formed in the primary race and adapted to cause coins to alter their path of travel in at least one plane as they move downward in the receiver body; and a downwardly inclined secondary coin race in said body defining at its upper end an aperture communicating with the primary race and sized to receive coins smaller than a selected diameter traveling along the altered path, said aperture including means for maintaining said smaller coins in a generally one-edge orientation as they move through the aperture into the secondary coin race.

30. A method for separating and rejecting coins comprising:

passing a coin along a downwardly inclined, primary coin race in a generally vertical attitude;

mechanically subjecting the coin within the race to an uneven lateral force such that the coin is deflected in both its direction and attitude of travel while maintaining its on-edge orientation, said lateral force carrying the coin to contact an upper and lower gauge, said upper gauge defining an accurate contact surface;

physically gauging the diameter of the deflected coin;

moving each deflected coin of a minimum diameter down the primary race; and moving each deflected coins of less than the minimum diameter down a secondary coin race.

* * * * *